United States Patent [19]

Kirkton

[11] 4,099,648

[45] Jul. 11, 1978

[54] STORAGE BOX

[76] Inventor: Richard G. Kirkton, 1994 Midwick Dr., Altadena, Calif. 91101

[21] Appl. No.: 834,597

[22] Filed: Sep. 19, 1977

[51] Int. Cl.[2] ..... B65D 7/00; B65D 43/16

[52] U.S. Cl. ..... 220/340; 220/4 R; 220/76; 220/62

[58] Field of Search ..... 220/4 R, 4 F, 67, 75, 220/76, 340, 62

[56] References Cited

U.S. PATENT DOCUMENTS

| | | | |
|---|---|---|---|
| 2,158,972 | 5/1939 | Weindel, Jr. | 220/62 |
| 2,233,326 | 2/1941 | Rooney | 220/340 |
| 2,658,101 | 11/1953 | Coxe, Jr. | 220/4 F X |
| 2,741,390 | 4/1956 | Moore | 220/4 R |
| 4,002,287 | 1/1977 | Saueth | 220/62 X |

*Primary Examiner*—William Price
*Assistant Examiner*—Steven M. Pollard
*Attorney, Agent, or Firm*—George J. Netter

[57] ABSTRACT

A tool box constructed of sheetlike metal includes a lower compartment which is the major containing part and within which the tools and other materials are received, and a cover which pivotally is received thereon. The upper edges of the lower compartment are formed into a rolled edge which both adds strength to the wall and provides safety against accidental cutting or other injury to the user. In fabrication, the lower compartment is formed from two sheetlike members, the first member having what will be its upper edges rolled into a generally cylindrical form and then the member is shaped to provide a front panel and two end panels. The second member is formed by bending a rectangular sheet into an L-shape, providing the bottom and rear walls for the containing part of the chest. The rear wall of the lower chamber has its upper edge rolled with a substantial gap provided which is received onto a similarly rolled edge of the cover to provide a pivotal hinge for the cover.

5 Claims, 8 Drawing Figures

STORAGE BOX

The present invention relates generally to a storage box of the kind frequently referred to as a tool box or tool chest, and, more particularly, to such a box of improved construction and method of making the same.

SUMMARY OF THE INVENTION

In the practice of the method of this invention there is provided a tool box constructed of sheetlike metal including a lower compartment which is the major containing part and within which the tools and other materials are received, and a cover which pivotally is received thereon. The upper edges of the lower compartment are formed into a rolled edge which both adds strength to the wall and provides safety against accidental cutting or other injury to the user.

In the method of fabrication, the lower compartment is formed from two sheetlike members, the first member having what will be its upper edges rolled into a generally cylindrical form and then the member is shaped to provide a front panel and two end panels. The second member is formed by bending a rectangular sheet into an L-shape, providing the bottom and rear walls for the containing part of the chest. The rear wall of the lower chamber has its upper edge rolled with a substantial gap provided which is received onto a similarly rolled edge of the cover to provide a pivotal hinge for the cover.

Spot welding of the edges or seams makes the lower compartment unitary. Conventional latches or buckle and hasp arrangements are provided for removably securing the cover and lower portion together. In addition, shelves or organizers of various kinds optionally can be secured within, or loosely received within the compartment. Moreover, the curled or rolled edge may be used to support these shelves or organizers.

DESCRIPTION OF A PREFERRED EMBODIMENT

Figure 1:
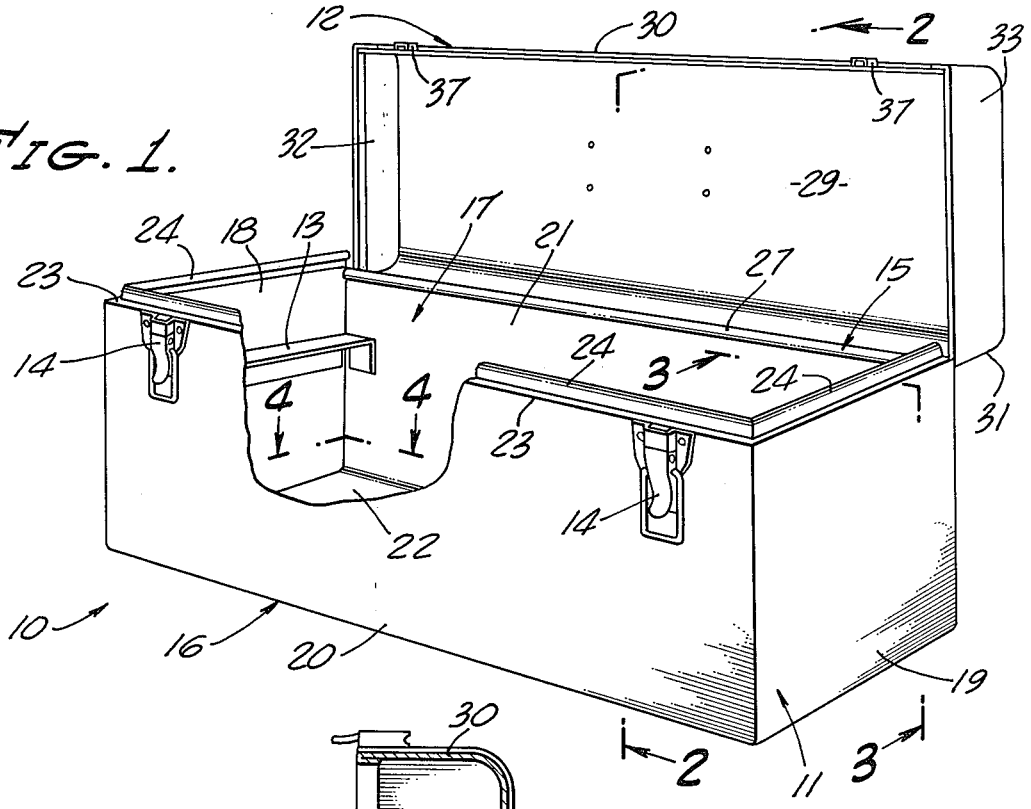
FIG. 1 is a perspective view, paritally fragmentary, of the tool chest of this invention.

With reference now to the drawing and particularly to FIG. 1, the tool chest of the subject invention is shown generally as at 10 and is seen to include an open-topped storage compartment 11, within which the tools, equipment, or other items are placed, and a cover 12, pivotally received over the compartment. Shelves 13 may be affixed to the storage compartment walls for supporting trays, so-called organizers, or the like in a conventional manner. Such trays also may be supported by the upper edges. Latches 14 are also applied as in the usual manner for temporarily or lockingly securing, as desired, the cover to the compartment.

Figure 2:
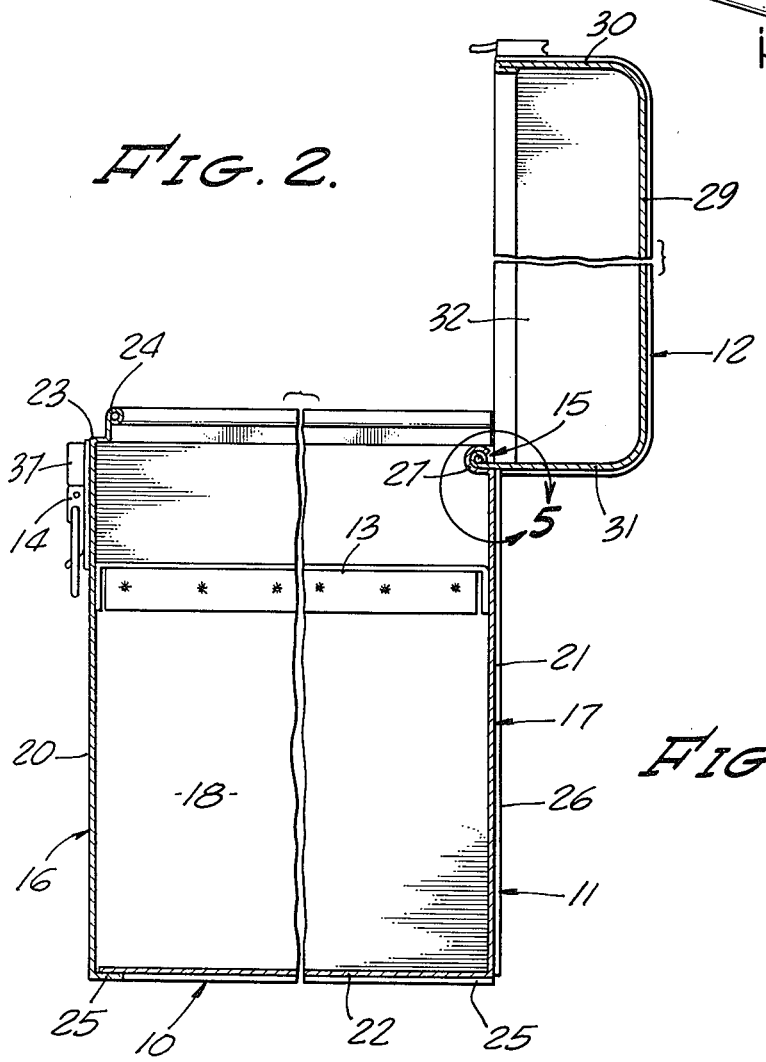
FIG. 2 is a sectional, end elevational, view of the tool chest of FIG. 1 taken along the line 2—2.

As can be best seen in FIG. 2, the cover and compartment 11 are pivotally secured together along a single common edge by a hinge 15, consisting of a lower edge of the cover 12 formed into a cylindrical member that is received within the hollow interior of a similarly shaped cylindrical member formed in the upper rear edge wall of the compartment. That is, as will be more particularly described, no extra parts or apparatus is required to accomplish hinging of the cover to the compartment, and all parts forming the hinge are constructed integrally from all portions of the cover and storage compartment.

Figure 7:
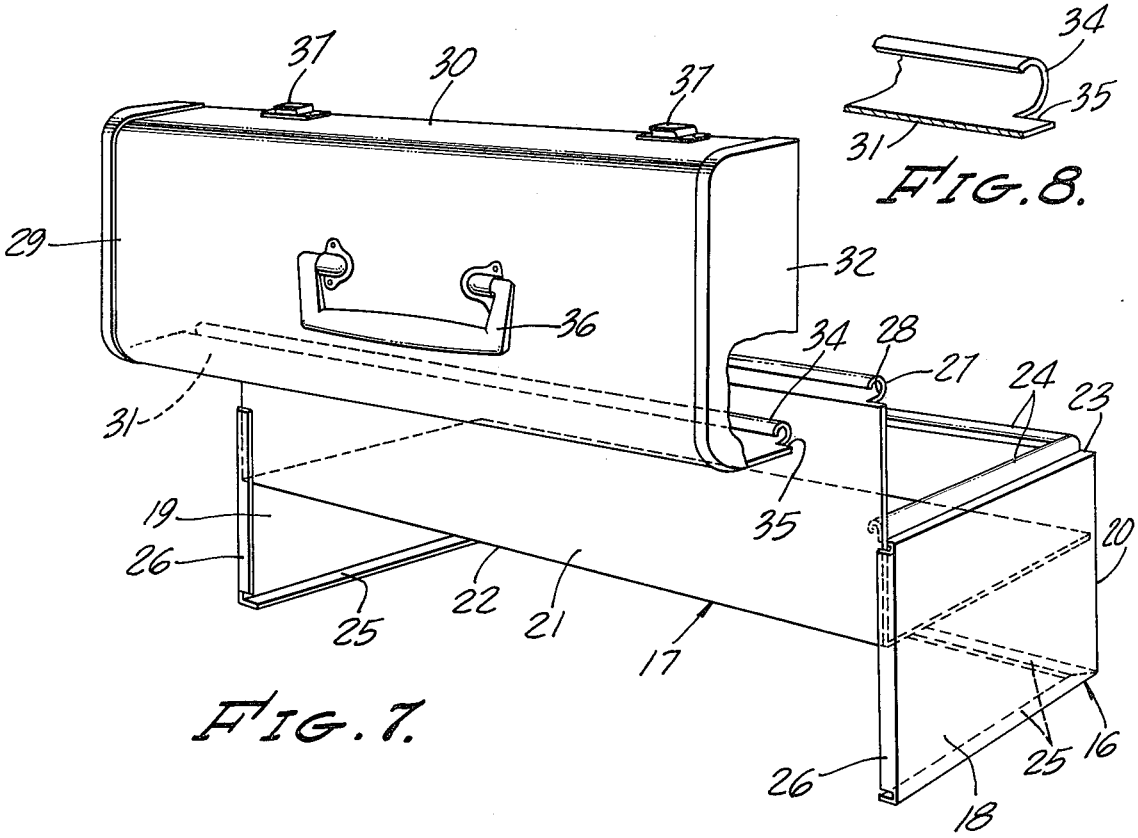
FIG. 7 shows a perspective view of the tool chest of FIG. 1 in partially assembled form.

Referring now simultaneously to FIGS. 1, 2 and 7, the lower compartment 11 is constructed from two preformed parts 16 and 17. The first part 16 comprises the two end walls or panels 18 and 19, and front panel 20, while the second part 17 forms the back panel 21 and bottom panel 22. When the parts are secured together, they form the open-topped compartment of FIG. 1.

With respect to the process of fabrication of the part 16, the initial blank is a single, elongated, rectangular sheet of steel. What will be the upper longitudinal edge of the sheet in final condition, has a substantial extent of its margin formed inwardly at right angles to the sheet surface defining a ledge 23 and notched at two points corresponding to the limits of the front panel. The outermost edge margin is then formed upwardly at 90° to the ledge and rolled inwardly, delineating a circular or rounded upper edge 24. The final shape of the upper edge is a rolled edge 24, offset inwardly from the main sheet by the ledge 23.

Next, the lower edge is notched and mitre-cut at what will be the front corner locations, after which the lower edge margin is formed inwardly (i.e., in the same direction as ledge 23) at 90° to the sheet surface defining a supporting shelf 25 for the bottom panel as will be described. Similarly, the end edge margins of the sheet are notched at the ends and bent to retaining members 26.

The part 16 with its edge margins modified in the manner described in the preceding paragraphs is then formed about the notched portions as fold lines to a generally C-shape, with the end panels at right angles to the front panel.

The storage compartment part 17, comprising the rear and bottom wall panels 21 and 22, respectively, is formed from a single, flat sheet of steel which is bent in, say, a breaking mill, so that the two panels are at right angles to one another with the panel 22 having a width and length identical to the internal bottom dimensions formed by part 16. The longitudinal edge of panel 21 is contoured or rolled into an elongated partly closed or curled edge 27 running the full length of the edge and enclosing a slotlike opening 28 facing outwardly of the back panel.

The back panel 21 is so dimensioned that when the part 17 is received within the space formed by the panels 18–20 and the bottom panel 22 is resting on the shelves 25, the cylindrical edge 27 is at substantially the same vertical height from the bottom panel as is the ledge 23.

Figure 3:
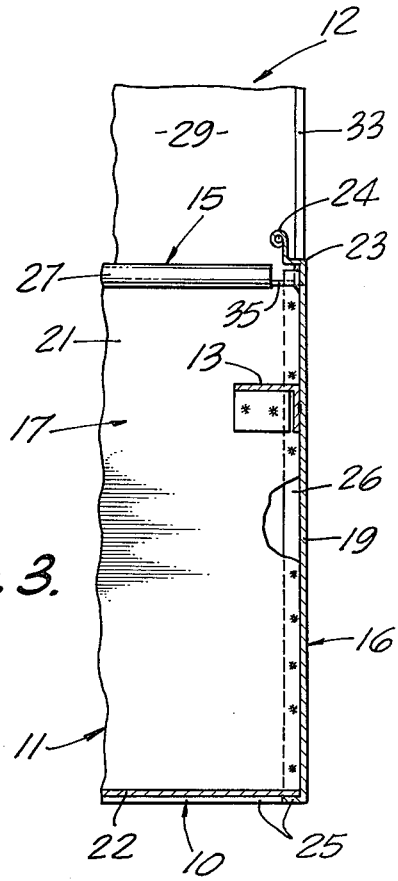
FIG. 3 is a side elevational, sectional, partially fragmentary, view taken along the line 3—3 of FIG. 1.
Figure 4:
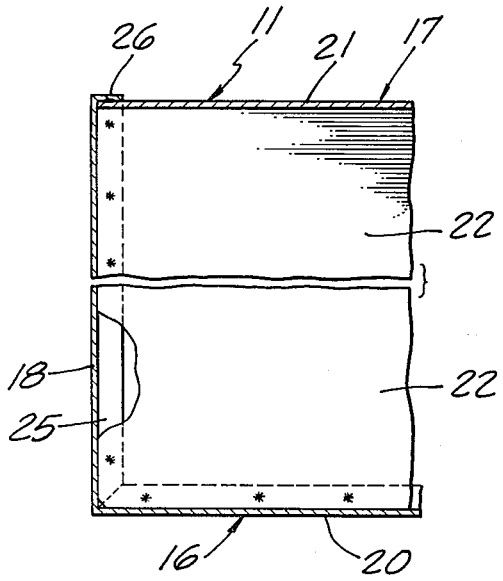
FIG. 4 is a top plan, sectional, partially fragmentary view, taken along the line 4—4 of FIG. 1.
Figure 6:
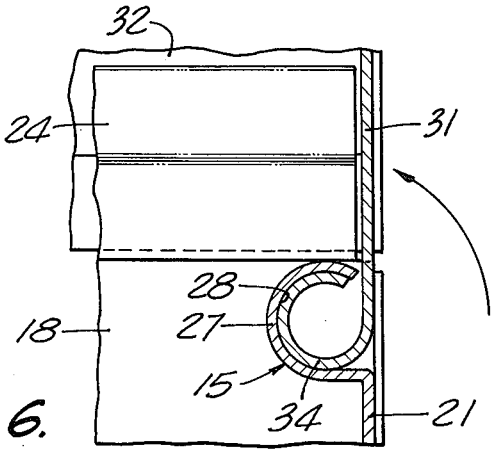
FIG. 6 is a view similar to FIG. 5, showing the parts rotated relative to one another.

The parts 16 and 17 are then assembled together as in FIG. 6 and the respective contacting portions along shelves 25 and retaining members 26 are secured together by spot welding (FIGS. 3 and 4).

Figure 5:
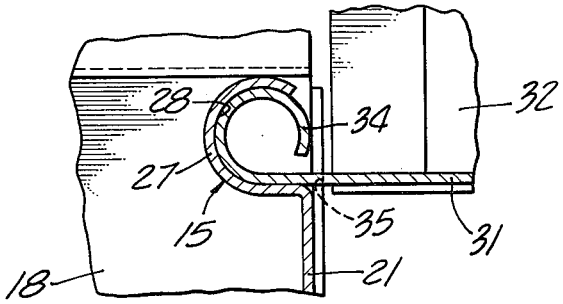
FIG. 5 is an enlarged, fragmentary view of the hinge end shown in FIG. 2.
Figure 8:
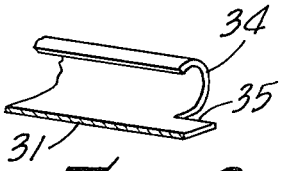
FIG. 8 is an enlarged, fragmentary view of the cover edge.

The major part of cover 12 is constructed of a rectangular sheet of steel which is formed about two parallel, longitudinal fold lines to provide a top 29, front 30 and rear panels 31. Two end caps 32 and 33 can enclose the end openings of the panels 29–31, with the dimensions of the panels being such as to permit fitting receipt onto the opening of the compartment 11. The back panel 21 includes a lower edge which is formed first inwardly and then toward the top panel 29 to provide a cylindrical element 34 extending the full length of the cover 12 and of such relative dimensions as to permit receipt within the opening 28 of edge 27 along the back panel 21 upper edge, thereby collectively forming a hinge connection for the cover to the compartment. See in particular FIGS. 5 and 6, which show the detailed assembly of the hinge parts. The hinge assembly is accomplished by sliding the rounded edge 34 longitudinally into the opening of 27 prior to welding of the back panel 20 to the end and bottom panels. As shown in FIG. 8, at each horizontal end of the rounded hinge element 34, a portion of the element is notched as at 35, which, when the cover is completely open, will cooperate with the rear panel 21 to limit movement of the cover to a predetermined maximum through contact of the edge of 35 with the back surface of panel 21.

The cover 12 for final use is conventionally provided with a lifting and carrying handle 36 and latching hardware 37, the latter for cooperating with similar means 14 on the storage compartment. Although not a part of this invention, the entire storage box 10 is usually provided with a suitable painted surface such as a colored "crackle" finish, for example.

I claim:

1. A storage box having a container and cover, comprising:

a first elongated metal sheet having two opposite end portions bent generally normally to the central portion forming the container front and two end panels;

a second metal sheet bent to form an L-shaped member, said member being secured to the first metal sheet defining back and bottom panels for the container;

the exposed edges of the front, two end and back panels being contoured into generally cylindrical edges; and the cover includes an edge which is rolled into cylindrical shape and mated with the container rear panel edge to form a hinge between the cover and the container.

2. A storage box as in claim 1, in which the contoured cylindrical edges of the front and end panels are spaced inwardly of the major sheet planes of the respective front and end panels.

3. A storage box as in claim 1, in which the L-shaped member is secured to the first metal sheet by welding.

4. A storage box as in claim 1, in which edge margins of the end panels are formed inwardly about the edge margins of the bottom and back panels.

5. A storage box as in claim 1, in which there is further provided means incorporated in said hinge for limiting the degree of relative movement of the cover with respect to the container.

* * * * *